US007643776B2

(12) United States Patent
Walton et al.

(10) Patent No.: US 7,643,776 B2
(45) Date of Patent: Jan. 5, 2010

(54) INK BUILDING

(75) Inventors: Robin Walton, Culver City, CA (US); Sean Anderson, Pasadena, CA (US); Orhan E. Beckman, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 287 days.

(21) Appl. No.: 10/853,496

(22) Filed: May 25, 2004

(65) Prior Publication Data

US 2005/0264619 A1 Dec. 1, 2005

(51) Int. Cl.
*G03G 15/10* (2006.01)

(52) U.S. Cl. ..... 399/237

(58) Field of Classification Search ..... 347/7, 347/19, 21, 84, 85, 89, 93, 95, 98; 399/53, 399/54, 57, 233, 237
See application file for complete search history.

(56) References Cited

U.S. PATENT DOCUMENTS 4,175,489 A * 11/1979 Gattus ..... 101/366
5,669,965 A * 9/1997 Sawada et al. ..... 106/31.29
5,943,078 A * 8/1999 Nishimoto et al. ..... 347/89
6,052,195 A * 4/2000 Mestha et al. ..... 356/425
6,389,244 B1 * 5/2002 Shima et al. ..... 399/58
6,488,348 B1 * 12/2002 Miura et al. ..... 347/6
6,526,244 B1 * 2/2003 Viturro et al. ..... 399/237
6,679,597 B2 * 1/2004 Ohsawa et al. ..... 347/95
6,776,199 B2 * 8/2004 Crivellaro et al. ..... 141/144
6,817,692 B2 * 11/2004 Nakazawa et al. ..... 347/12
6,863,386 B2 * 3/2005 Hatada et al. ..... 347/84
6,938,984 B2 * 9/2005 German et al. ..... 347/43

* cited by examiner

*Primary Examiner*—Anh T. N. Vo

(57) ABSTRACT

An ink builder to build an ink for a hard copy device. The ink has at least one property that deteriorates in storage. The ink builder comprises an ink tank and apparatus for building ink in the ink tank from a plurality of components and/or an ink maintaining apparatus arranged to inhibit deterioration of the at least one property of the ink in the ink tank. The ink builder may be used in cooperation with a separate hard copy device to which the ink tank can be transferred. Methods of producing hard copies using such a hard copy device are also disclosed.

28 Claims, 4 Drawing Sheets

INK BUILDING

BACKGROUND

In some printers and other hard copy devices, the composition of the ink used is continually monitored and adjusted and/or replenished in use. For example, in a liquid-ink electrostatic printer, the ink solution may consist of a blend of ink concentrate and conductivity agent in an oil. In use of such an electrostatic printer, the ink solution is replenished by a solution often consisting of fresh oil, ink concentrate, and conductivity agent as needed. The solution is constantly mixed, for example, by being circulated by a pump, to produce a uniform composition.

If the level of ink concentrate or conductivity agent becomes too high, or if the ink solution becomes contaminated, or if it is desired to substitute a different ink solution, it has in the past been generally necessary to drain the relevant ink tank on the printer, clean the ink tank and pipe-work, refill the ink tank with clean oil, and build up the ink solution to a usable concentration of ink concentrate and conductivity agent. Both the cleaning and the rebuilding of the ink solution take considerable time, during which the printer is unable to print. Because the ink solution generally requires continual mixing, if the printer is powered down for an extended length of time the ink concentrate and oil content separates, and must be cleaned out either at shutdown or at startup, and the ink solution must be rebuilt before the printer can be brought back into operation.

DETAILED DESCRIPTION

Figure 1:
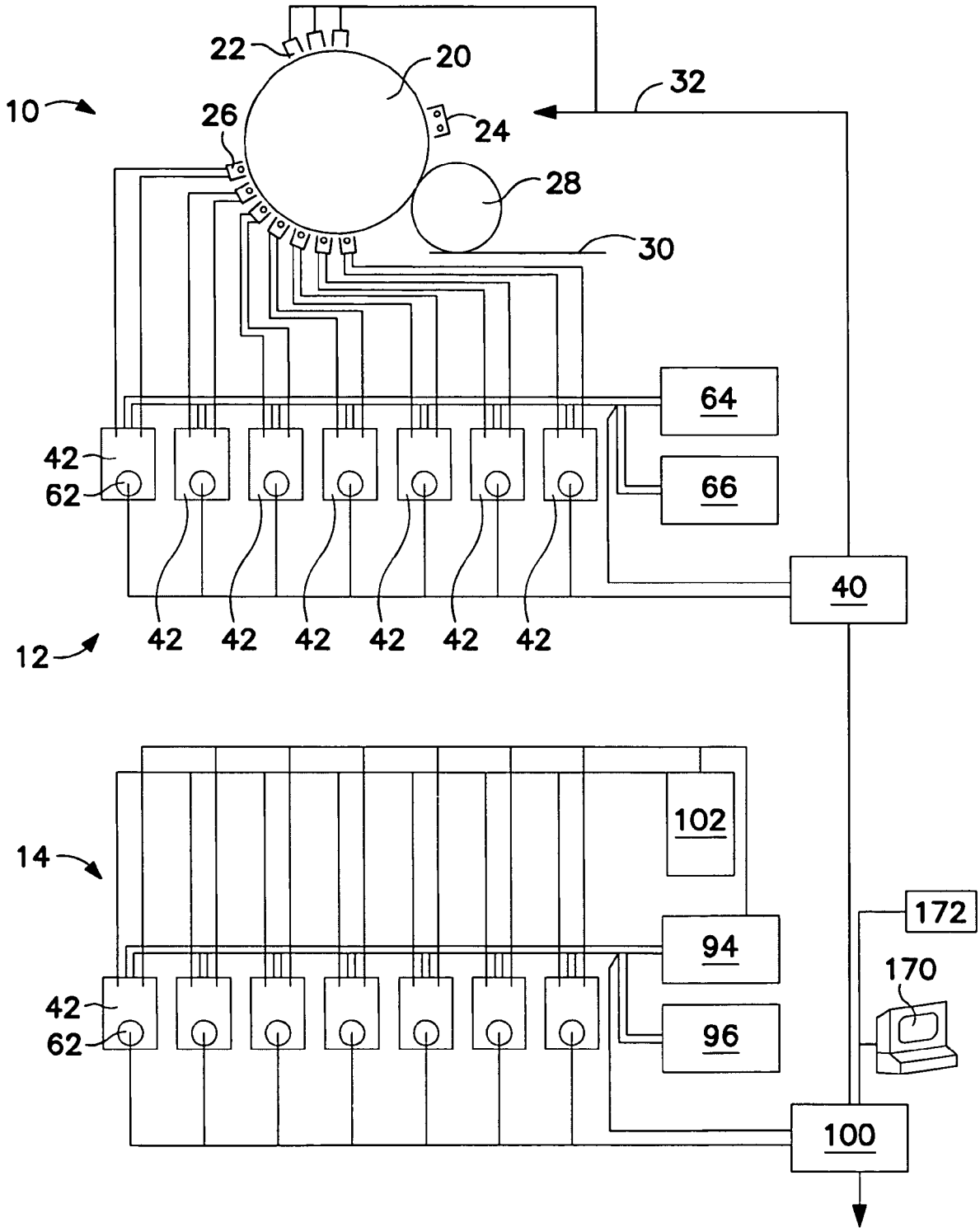
FIG. 1 is a schematic view of one embodiment of printing system according to the invention.

Referring to the accompanying drawings, and initially to FIG. 1, one embodiment of a hard copy production system according to the invention is a printing system indicated generally by the reference numeral 10. The printing system 10 comprises a hard copy device that in this embodiment is a printer indicated generally by the reference numeral 12 and an ink builder indicated generally by the reference numeral 14. In this embodiment, the printer 12 is a seven-color liquid-ink electrostatic printer. The printer 12 has a photoconductive cylinder 20, with the usual imaging and cleaning stations 22, 24, and seven developing stations 26. The image formed on the photoconductive cylinder 20 may be transferred to a blanket 28, and from the blanket to a sheet of paper or other print medium 30. A controller 40 controls the operation of the printer 12 through control lines 32.

The seven developing stations 26 may be used for primary colors such as cyan, yellow, magenta, black, orange, violet, (CMYKOV) and a spot color. Other combinations of colors may be used, for example, cyan, yellow, magenta, black (CMYK) primary colors may be used while orange and/or violet may be replaced by a second and third spot color. Alternatively, fewer than or more than seven developing stations 26 may be used. The CMYK or CMYKOV colors are usually overlaid to build up the various colors needed for a color image. Spot colors may be used in commercial printing, for example, to print a distinctive color associated with the customer. A spot color is usually laid down in a separate page space from the CMYK or CMYKOV overlay. However, a spot color is sometimes laid down on top of a single other color to form a "duotone."

Figure 2:
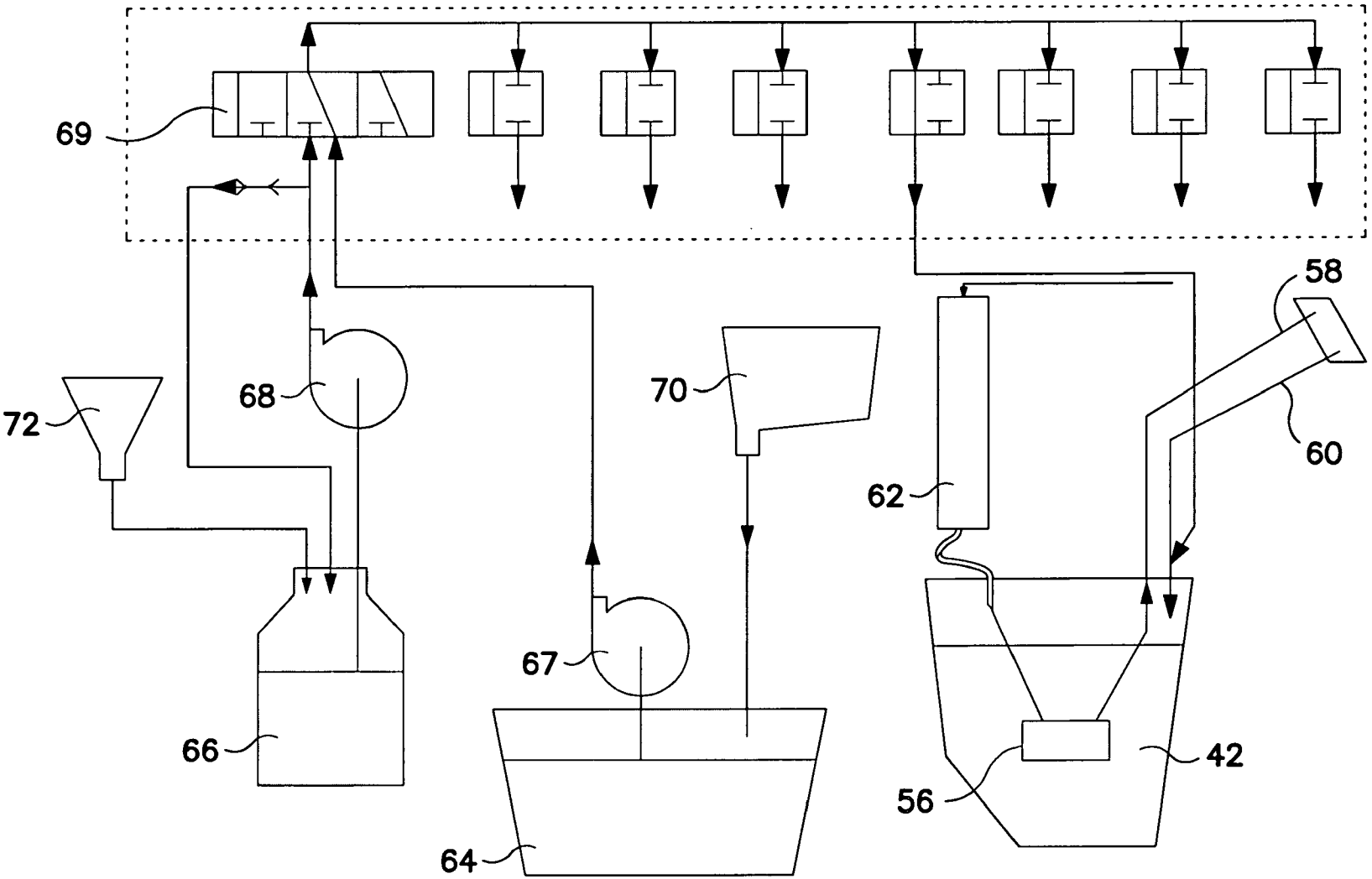
FIG. 2 is a schematic view of parts of one embodiment of an ink building section of a printer forming part of the printing system shown in FIG. 1.

Referring also to FIG. 2, each developing station 26 is supplied by a respective ink tank 42. Each ink tank 42 has a pump 56 under control of the controller 40 that can deliver ink, which in this embodiment is ink solution, from the ink tank through a pipe 58 to the respective developing station 26. Used ink solution is returned from the developing station 26 through a pipe 60. In this embodiment, when the printer is in operation, the ink solution is constantly circulated through the pipes 58, 60. This maintains even mixing of the ink solution both in the tank 42 and in the pipes 58, 60 and the developing station 26. Thus, evenly mixed ink solution is immediately available whenever it is needed for printing. In the interests of clarity, only one ink tank 42 is shown in FIG. 2. All of the ink tanks 42 have substantially identical connections. The ink tanks can be removed easily from the printer 12, as is described in more detail below. The pump 56 is equipped with a filter, which is coarse enough to permit the mixed ink solution to flow through it freely, but removes coarse contaminants.

Each ink tank 42 has a dispenser 62 for colorant, which in this embodiment is ink concentrate, and has feeds for carrier liquid, which in this embodiment is imaging oil, from an oil tank 64 and for conductivity agent from a conductivity agent tank 66. In this embodiment, the ink concentrate is a can of ink paste. The ink paste is stable in the can, and is suspended in the oil in use. Although the liquid in the tanks 64 is referred to as "ink solution," in this embodiment the "ink solution" is a suspension of very fine solid ink or toner particles in the imaging oil. In the embodiment shown in FIG. 2, the printer 12 has a single, common oil tank 64 with a pump 67, and a single, common conductivity agent tank 66 with a pump 68. These deliver oil and conductivity agent through a system of valves 69 to any selected ink tank or ink tanks. Each ink tank 42 also has sensors that monitor the concentration of oil and conductivity agent, the level of ink solution in the tank, and other properties of the ink solution. The controller 40 monitors the condition of the ink solution in the tanks 42 and controls the circulation pump 56 and the feeds from the ink paste dispenser 62, the oil tank 64, and the conductivity agent tank 66 so as to maintain the desired color density, conductivity, and other properties in the ink tanks. The oil tank 64 and the conductivity agent tank 66 can be refilled as necessary through inlet funnels 70, 72 respectively.

In some circumstances, for example, when a spot color, that is to say, a color specifically chosen for a particular print job, is to be produced, one of the ink tanks 42 may be provided with two or more ink paste dispensers 62 containing different colors of ink paste. The controller 40 then controls the dispensers 62 to produce an ink solution with a color that is a desired blend of the colors of the ink pastes. Alternatively, a single ink dispenser 62 may be loaded with an ink paste formulated to produce the spot color.

Figure 3:
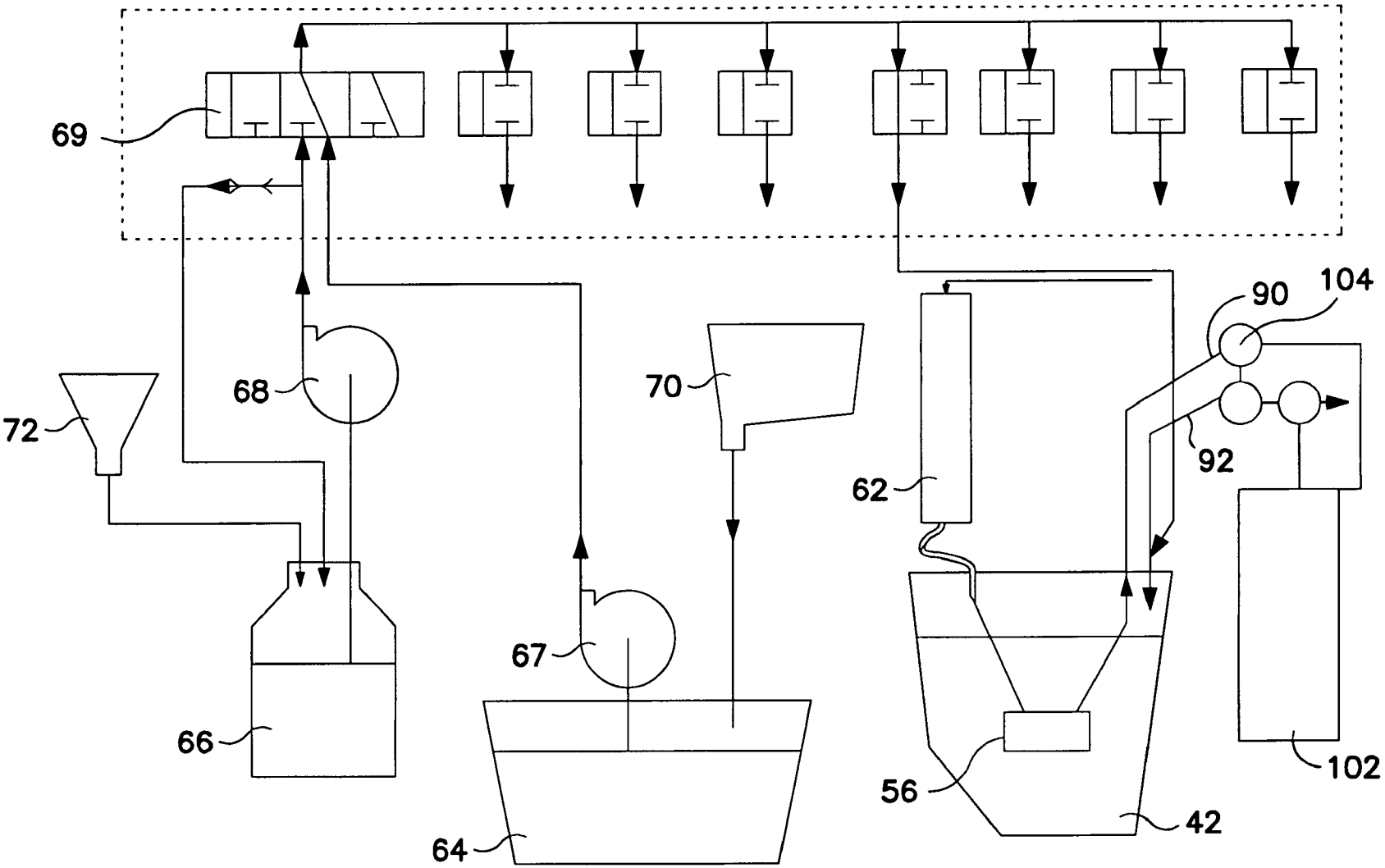
FIG. 3 is a schematic view of parts of one embodiment of an ink builder forming part of the printing system shown in FIG. 1.

In the embodiment shown in FIG. 3, the ink builder 14 comprises seven ink tanks 42. However, the ink builder 14 may have more or fewer ink tanks than seven, and may have more or fewer ink tanks than the printer 12. The ink tanks 42 are easily removable from the ink builder, and are the same as the ink tanks 42 of the printer 12. When the ink solution is stored in the tanks 42, it may deteriorate because the suspended ink particles may settle out and the composition of the ink becomes uneven. As mentioned above, each ink tank 42 has a pump 56. In the ink builder 14, the pump 56 stirs the ink solution in the tank by circulating it via a pair of pipes 90, 92. Each ink tank has one or more dispensers 62 for ink paste, and has dispensers that in this embodiment are feeds for oil from an oil tank 94 and for conductivity agent from a conductivity agent tank 96. The feeds for oil and conductivity agent in the ink builder 14 may be similar to the feeds for oil and conductivity agent in the printer 12.

When the ink is stored in the ink tank 42, the ink may deteriorate because of changes in the chemical composition of the ink. As mentioned above, each ink tank 42 also has sensors that monitor the concentration of oil and conductivity agent, the level of ink solution in the tank, and other properties of the ink solution. In the ink builder 14, the sensors are connected to a controller 100. The controller 100, like the controller 40 in the printer 12, monitors the condition of the ink solution in the tanks 42 and controls the circulation pump 56 and the feeds from the ink paste dispenser 62, the oil tank 94, and the conductivity agent tank 96 so as to maintain the desired color density, conductivity, and other properties in the ink tanks. A filter 102 can be connected into the circulation pipe 90 by operating three-way valves 104. The filter 102 is sufficiently fine to remove the ink and conductivity agent from the ink solution, leaving essentially clean oil. The filtered oil may be returned to the ink tank 42 through the circulation pipe 92. Alternatively, the filtered oil may be returned to the oil supply tank 94.

Figure 5:
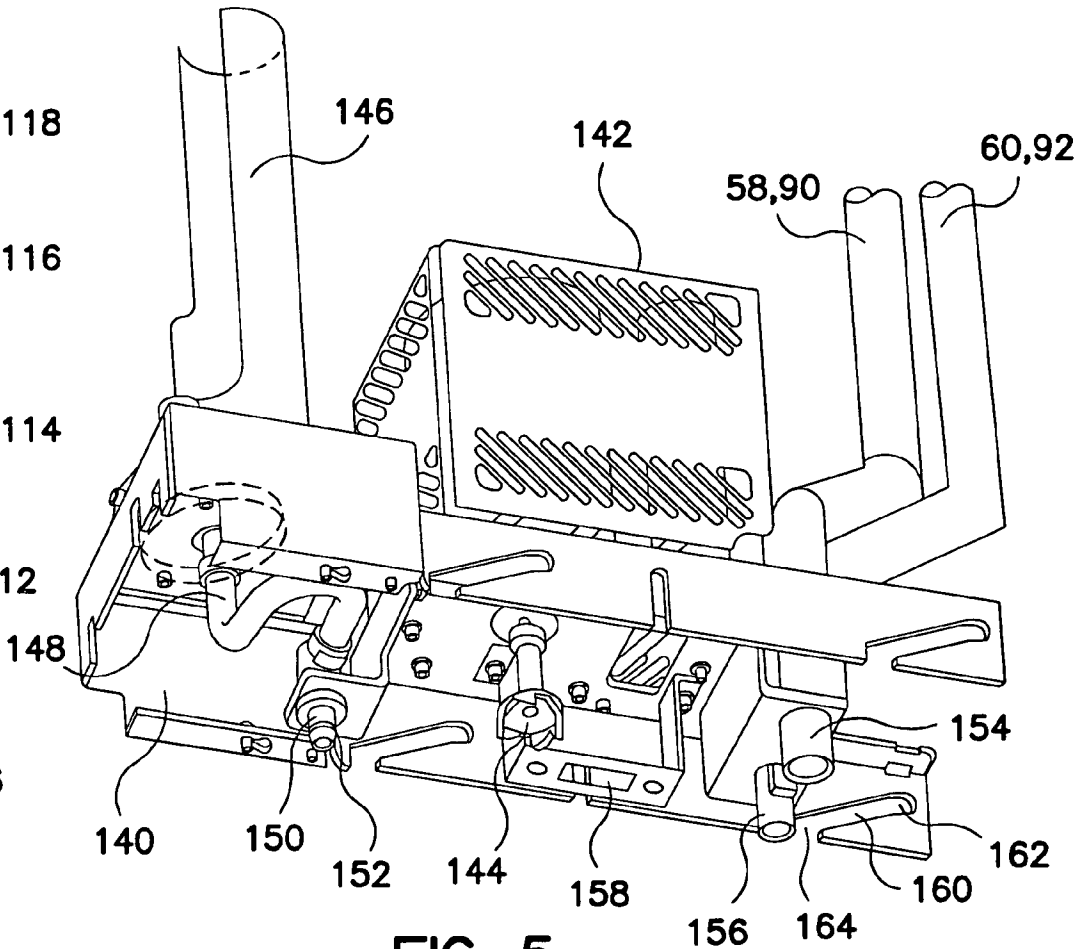
FIG. 5 is a perspective view of one embodiment of a motor lift unit for use with the ink tank shown in FIG. 4.
Figure 4:
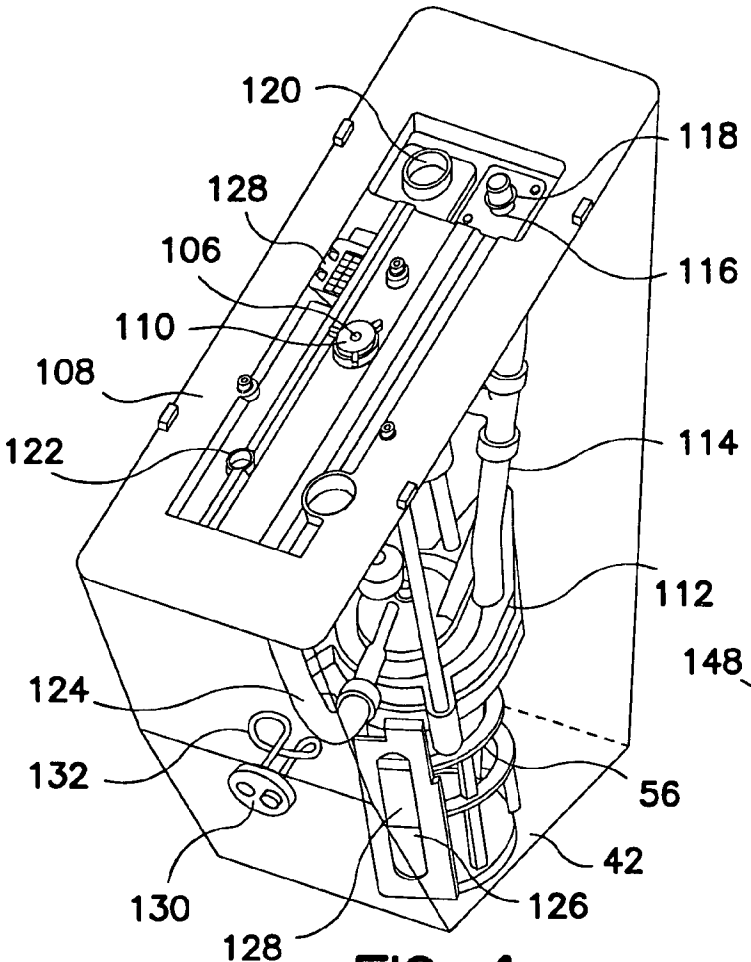
FIG. 4 is a perspective view of one embodiment of an ink tank.

Referring now to FIGS. 4 and 5, each ink tank 42 has its pump 56 inside the tank, so that in use the pump is immersed in the ink solution in the ink tank. The pump 56 is placed low in the tank, with its intake near the bottom of the tank, to avoid uncirculated ink solution settling out at the bottom of the tank. Alternatively, the pump 56 may be equipped with a stirrer or impeller that agitates the ink solution within the tank. The pump 56 is driven by a drive shaft 106 that extends upwards through a top cover 108 of the ink tank 42 to a coupler 110.

An outlet 112 of the pump 56 is connected by a hose 114 to a connector 116, with an O-ring 118, projecting above the top cover 108. An inlet 120 for returning ink solution is provided in the top cover 108. An inlet 122 for ink paste is provided with a smooth bore in which an O-ring can seal, and is connected by a hose 124 to the pump 56, so that ink paste fed into the ink tank 42 is immediately dispersed in the oil by the pump. A circuit board 126 carrying the various sensors 128 is mounted on the pump 56. The electrical conductivity of liquid electrostatic ink solution is typically sufficiently low that elaborate measures to protect the circuit board 126 from the liquid ink solution are not generally employed, although some may be employed in some applications. The circuit board 126 is wired to a connector 128 on the top cover 108.

A separate connector 130 is provided in the front of the ink tank 42 for water, which circulates through a tube 132 to warm or cool the ink solution in the ink tank 42.

Referring now especially to FIG. 5, for each ink tank 42, the printer 12 and the ink builder 14 are provided with a motor lift and tank interface unit 140, which fits over the top of the ink tank and connects with the top plate 108. The interface unit 140 has mounted on it an electric motor 142, with a descending output shaft ending in a coupler 144 that mates with the coupler 110 on the pump drive shaft 106, so that the motor 142 can drive the pump 56. The interface unit also has a receptacle 146 for the ink paste dispenser 62, with an outlet hose 148 leading to a connector 150 with an O-ring seal 152 that fits into the smooth bore of the ink paste inlet 122 on the top plate 108 of the ink tank 42.

The interface unit 140 also has an outlet connector 154, which has a smooth bore that fits over the O-ring 118 on the outlet connector 116 of the ink tank 42, and is connected to the outlet hose 58 or 90. The interface unit 140 also has an inlet connector 156, which opens out through the inlet connector 120 of the ink tank 42, and is connected to the return hose 60 or 92. The interface unit 140 also has an electrical connector 158 that mates with the connector 128 and is connected to the controller 40 or 100. The interface unit 140 is provided with angled slots 160 with horizontal upper ends 162 and horizontal lower ends 164 that are open downwards. By engaging crossbars or studs on a slider that moves backwards and forwards in a horizontal plane, the angled slots 160 enable the interface unit 140 to be raised and lowered by a controlled amount, between a position in which all of the connectors on the interface unit 140 are properly mated with their corresponding connectors on the top cover 108 of the ink tank 42 and a position in which all of the connectors are clear and the ink tank 42 can be removed horizontally from under the interface unit 140.

In normal use, the printer 12 prints using ink solutions from the ink tanks 42 in the printer, which are constantly replenished with oil from the tank 64, ink paste from their respective dispensers 62, and conductivity agent from the tank 66. In the course of the printing process, ink and a certain amount of conductivity agent is transferred to the image being printed, while most of the oil is returned to the ink tank 42. The ink solution in the ink tank 42 is thus both depleted in volume and reduced in concentration of ink and conductivity agent. Consequently, the composition of the ink solution can be maintained by additions of oil, conductivity agent, and ink paste.

Most of the time, the ink builder 14 maintains the composition of the ink solution in the ink tanks 42 in the ink builder. Once an ink tank 42 is full, and has the correct concentrations of ink and conductivity agent, little or no further additions or removals are generally necessary. The ink builder 14 may have a duplicate ink tank for each color of ink solution that the printer 12 is using. However, where a spot color is being used for a comparatively short job, or for a job that is about to end, a duplicate tank of ink solution of the spot color may be unnecessary. If there is a spare tank in the ink builder 14, for example, because the ink builder 14 has more tanks than are being used on the printer 12, or because a tank of a spot color is not being duplicated, the spare tank may be used to build a spot color for a forthcoming job.

There are many ink solution variables that affect the print quality. These include, for example, temperature, conductivity, viscosity, and humidity. If the concentration of ink or conductivity agent in the liquid ink solution in one of the tanks 42 on the printer 12 falls below the desired level, the concentration can be increased, by adding more from the ink paste dispenser 62 or the conductivity agent tank 66, as fast as the pump 60 can mix the addition into the contents of the tank. If the concentration rises too high, it can be reduced only as fast as the ink solution in the tank 42 is used for printing and can be replaced by oil 64. If a contaminant, including excess moisture, appears in the ink tank 42 it is eliminated in printing only as fast as the contaminated ink solution is applied to printing and replaced with clean ingredients. If sediment builds up in the tank 42 or on the sensors 68, it can be removed only by draining and cleaning the tank.

In any of those cases, absent the ink builder 14, the printer operator would be faced with the choice of using ink solution with an incorrect composition, and potentially producing sub-standard printing, unless and until the error gradually corrected itself, or stopping the press, discarding the contents of the ink tank 42, cleaning the ink tank and pipework 58, 60, refilling the ink tank with clean oil, and building up the ink and conductivity agent concentrations until the ink solution is usable. Rebuilding the ink solution typically involves adding conductivity agent and ink concentrate manually in stages until the concentrations are approximately at the minimum edge of the usable range, and then allowing the controller 40 to raise the concentrations further as the printer 12 runs. In some embodiments of liquid-ink electrostatic printer 12, the entire cleaning and rebuilding process can take up to about 30 minutes before the printer can be used again.

In the present embodiment, if there is a duplicate ink tank of the same color in the ink builder 14, the operator merely needs to remove the tank of defective ink solution from the printer 12, clean the developing unit 26 and the pipes 58, 60 from the ink tank 42 to the developing unit 26, and insert the duplicate tank from the ink builder 14. Depending on the exact design of the printer 12, the cleaning may merely need squirting a slug of clean oil through the pipes 58, 60 from a hand oil can. In some embodiments of a printer, this can take about two minutes instead of about 30 minutes. Alternatively, a spare ink tank 42 containing clean oil may be temporarily inserted into the printer 12, and the clean oil circulated through the pipes 58, 60 and the developing unit 26 to flush them out.

The operator then inserts into the ink builder 14 the tank 42 of ink solution removed from the printer 12, and reconditions the ink solution by adding ink or conductivity agent as needed. This may still take 30 minutes, but the printer 12 is running during those 30 minutes with the duplicate tank 42 of ink solution, so little production time is lost. The ink solution seldom becomes defective, and the probability of the same ink solution in both the printer 12 and the ink builder 14 becoming defective at the same time is low.

If the defective ink solution has too much ink or conductivity agent in it, or is contaminated, the operator sets the valves 104 so as to pass the ink solution through the filter 102. The filter 102 can remove some of the ink and conductivity agent, leaving oil with a low concentration of ink or conductivity agent that can be built up again. Alternatively, the filter 102 can remove substantially all of the ink and conductivity agent, leaving essentially clean oil that can be re-used, even for ink solution of a different color. Filtration may thus also be used when a tank of spot color needs to be replaced by a different spot color. The old color is filtered out, the oil is reused, and the tank is built up to the new color. The ink and conductivity agent filtered out are discarded. However, a typical ink tank may contain a gallon (3.8 liters) of oil and a few ml of ink and conductivity agent. Typically, about 98% of the content of the tank is the oil, which in this embodiment can be recovered and reused. This process, according to some embodiments, may be beneficial to the environment in comparison with the situation absent the ink builder 14, where in practice the operator would frequently discard the entire tank of defective oil in order to replace the tank and resume printing as quickly as possible.

If the printer 12 is shut down for any reason, so that the controller 40 or the pumps 56 stop working, the ink solution in the tanks 42 will gradually separate and become useless. It may be possible to re-homogenize the ink solution when the printer is started up, but that may take considerable time. Alternatively, all of the tanks 42 can be emptied and cleaned before startup or (if the shutdown was planned) on shutdown. The tanks must then be filled with clean oil and the ink solutions rebuilt before printing can resume. However, if the ink builder 14 contains duplicate tanks, it may be possible to keep the ink builder operating during the shutdown. Then, at startup, the good duplicate tanks from the ink builder 14 are swapped into the printer 12, and printing can start immediately. The empty or separated ink tanks from the printer can then be rebuilt in the ink builder 14 while the printer is operating.

If a power outage disables the ink builder 14 as well as the printer 12, of course the ink solutions will need to be rebuilt on startup. However, if the printer 12 is shut down for maintenance, the ink builder 14 may be kept operating. If the printer 12 is shut down overnight or at weekends to save power, the ink builder 14 can economically be kept in operation, because, according to some embodiments, it may be a much smaller device.

As noted above, it may not be necessary to use all of the ink tanks in the ink builder 14 to duplicate ink tanks in the printer 12. For example, the ink builder 14 may have more tanks in it than the printer 12. For example, the printer 12 may not be using every tank, especially if one tank is used only for spot colors, and there is no spot color in the present print run. For example, if the printer is near the end of a run, the operator may judge that the risk of needing to replace the spot color tank is too small to need a duplicate. In any of those cases, an ink tank 42 in the ink builder that is not needed as a duplicate may be used to build a spot ink solution for a future print job.

If the print job is sent to the printer in machine-readable format, that format may include data specifying the ink colors to be used, including any spot colors. The print job may then be sent first to the controller 100 of the ink builder 14, which extracts the ink color data. If the ink color data include a color that is not already available, and there is an unused tank 42, the ink builder 14 may automatically start to build the specified ink solution. If there is no unused tank, the controller 100 of the ink builder may signal to the operator to release a tank from its previous assignment. When the ink solution is ready, the controller 100 of the ink builder 14 may send details of the actual ink solution to the controller 40 of the printer 12. The printer 12 then adds the new color to its list of available colors. When the printer 12 is ready to start printing the print job including the new color, the printer prompts the operator to change ink tanks. The operator then need merely select the color of the new ink solution from the list of available colors. Introducing a new spot color on the printer can thus be not only quick, but simple.

In the present embodiment, the controllers 40 and 100 are provided with software to interpret machine-readable document files. An example of such files is a file having data in the Adobe® PostScript® page definition language. The software on the controller 40 is arranged to convert an incoming file in a suitable format into commands causing the printer 10 to print the desired document. The incoming file may include information naming or otherwise specifying colors of ink solution to be used in printing the document. The incoming file may be "pre-separated" into a stack of single-color images, one for each of the developing stations 26.

The controller 100 of the ink builder 14 includes software to parse the file and identify the colors specified. If a file has been received that specifies a color that needs ink mixing, for example, a spot color, the controller 100 launches an alert to its operator on a console 170. A list of the spot colors used within the file is displayed. The controller 100 displays on the console 170 whether or not it recognizes the color names, and specifically lists the name of a color the controller thinks should be mixed as a spot color, rather than being generated on the press from the basic CMYK or CMYKOV colors. The operator has the option of using the color name read from the file (for the mixed ink solution) or of creating a new ink name.

As an alternative to using the software's internal formulations for the needed color, the operator may have the option of measuring the actual color of a sample swatch via a spectrophotometer 172.

Having selected one or more colors to be mixed as spot colors, an operator then mixes ink paste and fills a dispenser 62 for each new spot color. An ink profile is created, identifying the ink color and specifying the correct conductivity, density, and other properties to be measured by the sensors 128. The controller 100 then prompts the user to replace an existing profile for one of the tanks 42 in the ink builder 14. The controller 100 knows which tank 42 has clean oil in it via the sensors 128 in the tank, and may prompt the operator to select such a tank. If the operator chooses to use a tank full of ink solution, the system prompts the user to run a tank cleaning cycle. After the tank cleaning cycle has been run, and the oil in the tank 42 is satisfactorily clean, the new profile is applied to that tank. The operator mounts the dispenser 62 containing the newly mixed ink paste on the selected tank 42.

The ink solution is then built by gradually introducing the ink paste from the dispenser 62 and conductivity agent from the conductivity agent tank 96 into the clean imaging oil in the tank 42.

When the new ink solution has been successfully built by the ink builder 14, the system offers to configure the document file interpreting software to recognize the newly mixed color(s) within the file and relate the color(s) named in the file to the ink solution just mixed. If the operator agrees, the system sets up a configuration to recognize the color separation(s) named in the file and then reprocesses the document file to ensure that the configuration is valid and works correctly. If the original document file was pre-separated, not using the spot color that has just been mixed, then the separations must be regenerated using the new spot color. After processing the document file, a press ready file is generated. A preview of that file may be displayed on the display monitor of the console 170 showing all the colors/separations to be printed.

The document file is then sent to the controller 40 of the printer 12. When the printer 12 is ready to print that document, the system prompts the user to "replicate" the color on the printer 12 and to select which ink solution tank 42 on the printer is be replaced. The controller 100 sends the profile for the new ink solution to the controller 40, which loads the profile and associates it with the appropriate tank position. An operator swaps the tank 42 of freshly mixed ink solution from the off-line ink builder 14 with the tank from the printer 12, and swaps the dispenser 62 containing the ink paste for the new color. The printer 12 is then able to maintain, and print with, the new color.

Although embodiments of the present invention and its advantages have been described in detail, it should be understood that various changes, substitutions, and alterations can be made without departing from the spirit and scope of the invention as defined by the appended claims.

For example, the embodiment described comprises a seven-color printer 12. The printer 12 may have more or fewer than seven colors, such as one, four, five, or six colors. A six color printer may provide CMYK, orange and purple, or CMYK and two spot colors. A five color printer may provide CMYK plus a spot color. Other color palettes may be used for particular jobs.

The ink builder 14 need not be a single physical unit. It may have a compact structure, with several ink tanks sharing a single oil tank 94, conductivity agent tank 96, filter 102, and other common resources. However, any configuration that fits the space available in the printshop and serves a suitable function may be used. In a printshop having more than one printer 12, the printers may share one or more ink builders 14. In that case, the number of ink builder tanks for a color used by more than one printer may be less than the number of printers. Alternatively, if a particular ink solution becomes unusable very frequently, more than one ink tank duplicating that ink solution may be provided for a printer.

Although the printer 12 and the ink builder 14 can share some services, they may be as nearly independent as possible, to minimize the number of occasions on which a shutdown of or problem with a common service requires both the printer and the ink builder to be shut down simultaneously. Although the printer 12 and the ink builder 14 may be fairly close together, so that gallon tanks of ink solution can be quickly and easily transferred from one to the other, they may be sufficiently far apart that neither unit needs to be shut down when the other is being serviced.

Alternatively, an ink builder 14, especially one that has only one or a few ink tanks, could be used solely for preparing spot colors for future print jobs while the printer 12 is printing a previous job. By reducing the down time when a spot color is changed from 20 or 30 minutes to 2 minutes, this greatly reduces the minimum size of print run for which a spot color is economic.

Although some embodiments are directed to a liquid-ink electrostatic printer 12, embodiments of the present invention may be applied to any suitable form of printing ink in which active maintenance may be generally employed to inhibit deterioration of at least one property of the ink and keep it ready for printing. Although some embodiments are directed to a printer 12 receiving as input a file in machine-readable form, embodiments of the present invention may be directed to other forms of hard copy device, including photocopiers and facsimile machines.

Moreover, the scope of the present application is not intended to be limited to the particular embodiments of invention described in the specification. As one of ordinary skill in the art will readily appreciate from the foregoing description, processes, machines, articles of manufacture, compositions of matter, means, methods, or steps presently existing or later to be developed that perform substantially the same function or achieve substantially the same result as the corresponding embodiments described herein may be utilized to implement and carry out the present invention. Accordingly, the appended claims are intended to include within their scope such processes, machines, articles of manufacture, compositions of matter, means, methods, or steps.

The foregoing describes the invention in terms of embodiments foreseen by the inventors for which an enabling description was available, notwithstanding that insubstantial modifications of the invention, not presently foreseen, may nonetheless represent equivalents thereto.

What is claimed is:

1. An ink builder to build an ink for a hard copy device, said ink having at least one property that deteriorates in storage, comprising:

a removable ink tank adapted to be removed from the ink builder and to be installed in the hard copy device with the ink in the ink tank; and an ink maintaining apparatus arranged to inhibit deterioration of the at least one property of the ink in the ink tank, the ink maintaining apparatus comprising a pump inside the ink tank for circulating the ink through pipework leading from and returning to the ink tank, wherein the ink tank comprises a tube for circulating water to warm or cool the ink in the ink tank.

2. An ink builder according to claim 1, wherein the ink maintaining apparatus is arranged to prevent suspended ink particles from settling out of the ink.

3. An ink builder according to claim 1, wherein the ink maintaining apparatus further comprises a stirrer for agitating the ink in the ink tank.

4. An ink builder according to claim 1, wherein the ink maintaining apparatus comprises at least one sensor arranged to monitor a property of the ink.

5. An ink builder according to claim 4, wherein the at least one sensor is arranged to monitor a property of the ink selected from the group consisting of ink concentration, oil concentration, conductivity agent concentration, ink level, temperature, conductivity, viscosity, and humidity.

6. An ink builder according to claim 4, wherein the ink includes a first component and a second component and wherein the ink builder further comprises at least one dispenser arranged to add the first component without the second component to the ink in response to an indication from the sensor.

7. An ink builder according to claim 1, further comprising an apparatus to build ink in the ink tank from a plurality of components, the apparatus comprising:

a source of carrier liquid; and a source of colorant.

8. An ink builder according to claim 7, wherein the source of carrier liquid is a source of imaging oil.

9. An ink builder according to claim 7, wherein the source of colorant is a source of ink paste.

10. An ink builder according to claim 7, wherein the apparatus to build ink further comprises a source of conductivity agent.

11. An ink builder according to claim 1, further comprising a filter for removing a colorant from the ink.

12. An ink builder according to claim 1, further comprising a controller arranged to receive an input in machine readable form specifying a desired color of the ink, and to produce in machine readable form an output specifying the actual color of the ink.

13. An ink builder according to claim 12, wherein the controller is arranged to output a profile for the ink to enable another device comprising a controller arranged to respond to at least one sensor and to control an ink maintaining apparatus to inhibit deterioration of the ink.

14. An ink builder according to claim 12, wherein the controller is arranged to receive a document to be printed in machine readable form, and to identify a color of ink to be mixed for use in printing that document.

15. An ink builder according to claim 14, wherein the controller is arranged to display to a user a name for an identified color of ink.

16. An ink builder according to claim 14, wherein the controller is arranged to display to a user a composition for an identified color of ink.

17. An ink builder according to claim 14, wherein the controller is arranged to produce a color-separated form of the document for a printer in which the identified color is a separate color.

18. An ink builder according to claim 1, comprising a plurality of removable ink tanks, and wherein the ink maintaining apparatus is arranged to inhibit deterioration of the inks in different ink tanks independently.

19. An ink builder according to claim 18, each ink tank further comprising at least one source of colorant.

20. An ink builder according to claim 18, further comprising:

a source of carrier liquid; and a system of valves adapted to deliver carrier liquid from the source of carrier liquid to any selected ink tank or ink tanks.

21. An ink builder according to claim 18, further comprising:

a source of conductivity agent; and a system of valves adapted to deliver conductivity agent from the source of conductivity agent to any selected ink tank or ink tanks.

22. An ink builder according to claim 1, arranged to inhibit deterioration of ink for an electrostatic hard copy device.

23. An ink builder to build an ink for a hard CODY device, said ink having at least one physical property that deteriorates in storage, comprising:

a removable ink tank adaptec to be removed from the ink builder and to be installed in the hard copy device with the ink in the ink tank, the ink tank having an inlet port and an outlet port configured to concurrently circulate ink into and out of the ink tank when connected to the ink builder; and an ink maintaining apparatus arranged to stir the ink to inhibit deterioration of the at least one property of the ink in the ink tank, wherein the ink tank comprises a tube for circulating water to warm or cool the ink in the ink tank.

24. An ink builder according to claim 23, wherein the ink maintaining apparatus comprises a circulating pump inside the ink tank.

25. An ink builder according to claim 23, wherein the ink maintaining apparatus comprises a stirrer inside the ink tank.

26. An ink builder according to claim 25, wherein the ink maintaining apparatus comprises at least one sensor arranged to monitor a property of the ink.

27. An ink builder according to claim 26, further comprising at least one dispenser arranged to add a component to the ink in response to an indication from the sensor.

28. An ink builder according to claim 27, further comprising a filter for removing colorant from the ink.

* * * * *

UNITED STATES PATENT AND TRADEMARK OFFICE

CERTIFICATE OF CORRECTION

PATENT NO. : 7,643,776 B2
APPLICATION NO. : 10/853496
DATED : January 5, 2010
INVENTOR(S) : Robin Walton et al.

It is certified that error appears in the above-identified patent and that said Letters Patent is hereby corrected as shown below:

In column 10, line 26, in Claim 23, delete "CODY" and insert -- copy --, therefor.

In column 10, line 29, in Claim 23, delete "adaptec" and insert -- adapted --, therefor.

Signed and Sealed this

Sixth Day of July, 2010

David J. Kappos

David J. Kappos
*Director of the United States Patent and Trademark Office*